US007066150B2

(12) United States Patent
Egler et al.

(10) Patent No.: US 7,066,150 B2
(45) Date of Patent: Jun. 27, 2006

(54) FUEL INJECTION SYSTEM FOR INTERNAL COMBUSTION ENGINES

(75) Inventors: Walter Egler, Gerlingen (DE); Peter Boehland, Marbach (DE); Sebastian Kanne, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 416 days.

(21) Appl. No.: 10/203,214

(22) PCT Filed: Dec. 5, 2001

(86) PCT No.: PCT/DE01/04531

§ 371 (c)(1),
(2), (4) Date: Dec. 4, 2002

(87) PCT Pub. No.: WO02/46602

PCT Pub. Date: Jun. 13, 2002

(65) Prior Publication Data

US 2003/0136382 A1 Jul. 24, 2003

(30) Foreign Application Priority Data

Dec. 7, 2000 (DE) ..... 10060811

(51) Int. Cl.
*F02M 37/04* (2006.01)

(52) U.S. Cl. ..... 123/467; 123/447

(58) Field of Classification Search ..... 123/467, 123/500, 501, 458, 447; 239/93, 94, 95, 96, 239/88–92

See application file for complete search history.

(56) References Cited

U.S. PATENT DOCUMENTS 4,161,161 A * 7/1979 Bastenhof ..... 123/447
4,627,403 A * 12/1986 Matsumura ..... 123/447
5,012,786 A * 5/1991 Voss ..... 123/467
5,156,132 A * 10/1992 Iwanaga ..... 123/496
5,497,750 A * 3/1996 Mueller et al. ..... 123/446
5,524,826 A * 6/1996 Mueller et al. ..... 239/88
6,209,525 B1 * 4/2001 Konishi et al. ..... 123/467
6,328,017 B1 * 12/2001 Heinz et al. ..... 123/467
6,431,148 B1 * 8/2002 Guggenbichler et al. ... 123/467
6,561,165 B1 * 5/2003 Hlousek ..... 123/467

FOREIGN PATENT DOCUMENTS

| | | |
|---|---|---|
| DE | 199 57 591 A | 10/2000 |
| DE | 199 58 249 A | 11/2000 |
| EP | 0 995 902 A | 4/2000 |
| EP | 1 036 932 A | 9/2000 |

* cited by examiner

*Primary Examiner*—Carl S. Miller
(74) *Attorney, Agent, or Firm*—Ronald E. Greigg

(57) ABSTRACT

A fuel injection system with a fuel injection valve and a control valve, which control valve has a control valve member that can move longitudinally in a control valve bore. The control valve member is provided with a control valve sealing surface, which cooperates with a control valve seat and thereby controls the connection between a first pressure chamber and a second pressure chamber, where the first pressure chamber is connected to a high-pressure accumulation chamber. A bore is embodied in a valve body and contains a piston-shaped valve needle whose end oriented toward the combustion chamber controls the opening of at least one injection opening by virtue of the fact that it executes a longitudinal movement due to the impingement of the pressure in a pressure chamber; the pressure chamber is connected to the second pressure chamber by means of a supply conduit. The first pressure chamber is connected by means of a throttle to a damping chamber that is otherwise closed, as a result of which, pressure oscillations that are produced by the closing of the control valve are rapidly damped.

14 Claims, 7 Drawing Sheets

FUEL INJECTION SYSTEM FOR INTERNAL COMBUSTION ENGINES

CROSS-REFERENCE TO RELATED APPLICATIONS

This application is a 35 USC 371 of PCT/DE 01/04531 filed on Dec. 5, 2001.

BACKGROUND OF THE INVENTION

1. Field of the Invention

The invention is directed to an improved fuel injection system for internal combustion engines.

2. Description of the Prior Art

A fuel injection system of the type with which this invention is concerned is known, for example, from the document DE 197 01 879 A1 and includes a fuel tank from which fuel is delivered into a high-pressure accumulation chamber by a high-pressure pump. A control unit maintains a predetermined high fuel pressure in the high-pressure accumulation chamber. A number of high-pressure lines, which corresponds to the number of combustion chambers of the internal combustion engine, each lead from the high-pressure accumulation chamber to a respective fuel injection valve; the fuel injection valve can be connected to the high-pressure line by means of a control valve. The control valve and the fuel injection valve here are frequently disposed in a single housing to save space. The fuel injection valve here has a valve needle, which is guided in a bore and is encompassed by a pressure chamber in the region oriented toward the combustion chamber. A pressure surface is embodied on the valve needle, which is acted on by the fuel in the pressure chamber so that when a particular opening pressure is achieved in the pressure chamber, the valve needle executes a longitudinal movement counter to a closing force, thus unblocking at least one injection opening through which fuel travels from the pressure chamber into the combustion chamber of the engine. The control valve of the fuel injection system is embodied as a 3/2-port directional-control valve, which in one position, connects the high-pressure accumulation chamber to the pressure chamber of the fuel injection valve and in a second position, breaks the connection to high-pressure accumulation chamber and connects the pressure chamber to an overflow fuel chamber, which is provided in the valve body and which is connected to the fuel tank by means of a line, so that a low fuel pressure constantly prevails in the overflow fuel chamber. If the control valve switches from the closed position into the open position, then a pressure wave is produced, which travels through the supply conduit into the pressure chamber and produces an overpressure there, i.e. the injection of the fuel occurs at a pressure that is considerably higher than the pressure in the high-pressure accumulation chamber. As a result, high injection pressures are achieved with a moderately high pressure in the high-pressure accumulation chamber and in the high-pressure fuel-carrying parts of the fuel injection system. Since the fuel in the supply lines is in motion because of the open control valve during the injection, when the control valve is closed, the moving fuel is abruptly stopped so that the kinetic energy of the fuel is converted into compression work. This produces pressure oscillations, which complicate the precise metering and proportioning of the injection quantity in a second injection immediately following the first injection, since the state of the control valve is not precisely known due to the pressure oscillations.

The object of the current invention, therefore, is to design a fuel injection system, which permits a more precise metering of the injection quantity and more precise setting of main injections, preinjections, and secondary injections.

SUMMARY OF THE INVENTION

The fuel injection system according to the invention has the advantage over the prior art that the pressure oscillations that occur upon closing of the control valve, i.e. upon interruption of the connection to the high-pressure accumulation chamber, are damped through the connection of the first pressure chamber and the high-pressure line to a damping chamber by means of a throttle and therefore decay rapidly. As a result, after closing, the control valve returns very rapidly to a stationary state so that it is possible to execute a second injection very shortly after the preceding injection and to be able to control its injection quantity very precisely. The control valve is a 3/2-port directional-control valve in a control valve body and contains a control valve member, which is guided so that it can move longitudinally in a control bore. Through a radial enlargement of the control bore, two pressure chambers are produced in the control bore; the first pressure chamber is connected to the high-pressure accumulation chamber and the second pressure chamber is connected to the pressure chamber provided in the fuel injection valve. When the control valve member is in the closed position, i.e. the first position, the connection from the first pressure chamber to the second pressure chamber is closed and the second pressure chamber and therefore the pressure chamber of the control valve are connected to an overflow fuel chamber and are consequently unpressurized. In the open position of the control valve member, the connection from the first pressure chamber to the second pressure chamber is open and the connection of the second pressure chamber to the overflow fuel chamber is closed so that the high-pressure accumulation chamber is connected to the pressure chamber of the fuel injection valve.

The first pressure chamber is connected to a damping chamber by means of a throttle, thus damping pressure oscillations of the kind that occur in the first pressure chamber and also in the high-pressure accumulation chamber when the control valve opens and closes. Through a suitable embodiment of the throttle, the damping characteristic curve can be selected so that pressure oscillations in the pressure chamber decay completely after only a few oscillation periods.

In a first advantageous embodiment of the subject of the invention, the damping chamber is embodied as bore, which extends in the valve holding body, parallel to its longitudinal axis. As a result, the damping chamber can be produced in already known fuel injection valves, without having to rebuild them and without having to change the outer diameter of the fuel injection valve.

In another advantageous embodiment, the valve holding body is clamped axially against the control valve body, with the interposition of an intermediary disk. The bore that constitutes the damping chamber extends partially in the control valve body, through the intermediary disk, and for a greater distance in the valve holding body. The throttle is embodied in the intermediary disk so that by exchanging the intermediary disk for one that has a different throttle, the fuel injection valve can be adapted to the requirements at hand, without having to make other structural changes to the fuel injection valve.

In another advantageous embodiment of the subject of the invention, the damping chamber is comprised of two parallel bore sections, which each extend in the valve holding body.

The two bore sections of the damping chamber are connected to each other by a lateral conduit so that a short valve holding body can be produced without changing the volume of the throttle bore.

In another advantageous embodiment, the two bore sections of the damping chamber are connected by a lateral bore, which is disposed in a shim, which is disposed between the valve holding body and the valve body. This embodiment eliminates a lateral connection of the bore sections inside the valve holding body, which can only be produced in a relatively costly manner, for example with the aid of an end-milling cutter. Embodying the lateral connection in the shim makes it possible to form the two bore sections of the damping chamber starting from one of the ends of the valve holding body.

In another advantageous embodiment of the subject of the invention, a shutoff valve is disposed between the damping chamber and the first pressure chamber, which only opens the connection from the first pressure chamber to the damping chamber when a damping is desired. The overpressure during the opening of the control valve, which is sought for injecting with the highest possible pressure, is reduced somewhat by the continuous connection of the first pressure chamber to the damping chamber. Therefore, the shutoff valve closes the connection between the first pressure chamber and the damping chamber during the opening phase of the control valve. After the end of the injection, the shutoff valve is opened so that the pressure waves in the first pressure chamber can be rapidly damped as before. This shutoff valve permits an optimal injection pressure to be achieved and simultaneously permits a damping of pressure oscillations, which permits an exact metering of the injections.

In another advantageous embodiment, the shutoff valve is controlled by the pressure in the second pressure chamber. When the control valve is open, the pressure that prevails in the second pressure chamber is at least approximately the same as that in the first pressure chamber and the shutoff valve is closed by this pressure. If the control valve closes the connection from the first pressure chamber to the second pressure chamber, then the pressure in the second pressure chamber falls and the shutoff valve therefore opens the connection from the first pressure chamber to the damping chamber. Then the pressure oscillation is damped in the manner outlined above. The control by means of the pressure in the second pressure chamber renders an additional electronic control of the shutoff valve superfluous.

In another advantageous embodiment of the subject of the invention, the control valve body is made of a hard steel, while the valve holding body in which the damping chamber is embodied is made of a relatively soft steel. The control valve body contains the control valve, which has sealing surfaces that are subjected to powerful stresses. Being made of a hard steel reduces the wear in the vicinity of the valve seat of the control valve. By contrast, it is advantageous to use a softer steel to make the valve holding body because it does not have any seat surfaces or sealing surfaces and consequently no powerful mechanical stress occurs. The cavity that constitutes the damping chamber can be inexpensively and rapidly produced in the soft steel.

BRIEF DESCRIPTION OF THE DRAWINGS

Various exemplary embodiments of the fuel injection system according to the invention are shown in the drawings, in which.

DESCRIPTION OF THE PREFERRED EMBODIMENTS

Figure 1:
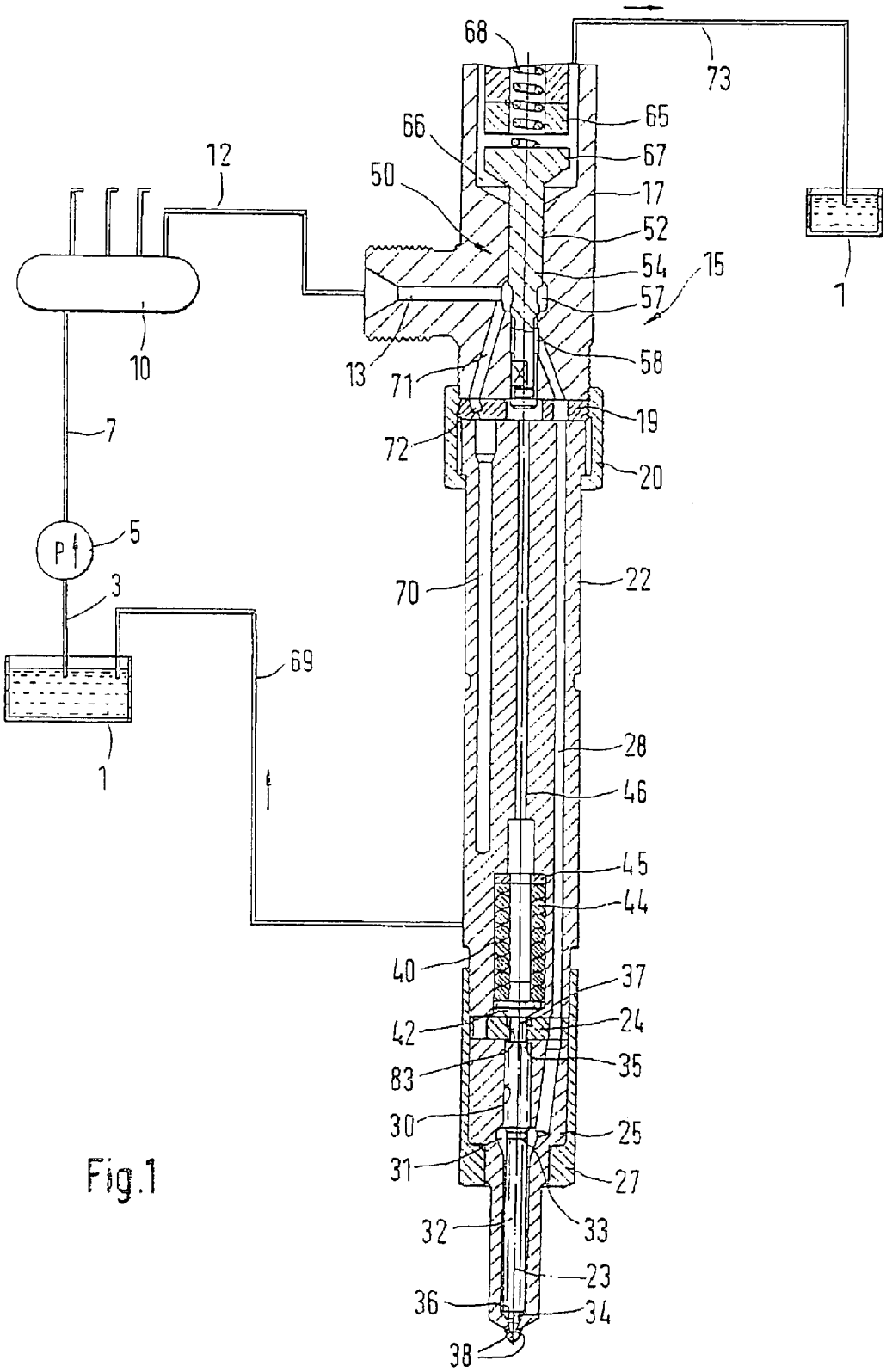
FIG. 1 shows a longitudinal section through a fuel injection valve and schematically depicts the high-pressure fuel delivery.

FIG. 1 shows a longitudinal section through a fuel injection valve according to the invention, which constitutes a fuel injection system along with the schematically depicted high-pressure fuel delivery and the likewise schematically depicted overflow fuel system. Fuel from a fuel tank 1 is supplied via a fuel line 3 to a high-pressure pump 5, which delivers the fuel at high pressure via a supply line 7 to a high-pressure accumulation chamber 10. A control unit, not shown in the drawing, maintains a predetermined high fuel pressure in the high-pressure accumulation chamber 10. High-pressure lines 12 lead from the high-pressure accumulation chamber 10 and are each connected to a fuel injection valve 15, of which only one is shown by way of example in the drawing. The fuel injection valve 15 is comprised of several parts and includes a control valve body 17 in which a control valve 50 is disposed. The control valve body 17 is clamped axially against a valve holding body 22, with the interposition of an intermediary disk 19, by means of a retaining nut 20. At the other end of the valve holding body 22, which is oriented toward the combustion chamber, the valve holding body 22 rests against a valve body 25, with the interposition of a valve shim 24, which valve body 25 is clamped against the valve holding body 22 by means of a retaining nut 27. A bore 30 is embodied in the valve body 25 and at the end of this bore oriented toward the combustion chamber, an essentially conical valve seat 36 is embodied, in which at least one injection opening 38 is disposed. The bore 30 contains a piston-shaped valve needle 32, which is guided in a sealed fashion in a section of the bore 30 remote from the combustion chamber and tapers toward the combustion chamber, forming a pressure surface 33. At its and oriented toward the combustion chamber, the valve needle 32 transitions into an essentially conical valve sealing surface 34, which cooperates with the valve seat 36 and closes the injection openings 38 when in the closed position, i.e. when in contact with the valve seat 36. At the level of the pressure surface 33, a radial enlargement of the bore 30 forms a pressure chamber 31, which continues, in the form of an annular conduit encompassing the valve needle 32, until it reaches the valve seat 36. By means of a supply bore 28, which extends in the valve body 25, the valve shim 24, the valve holding body 22, the intermediary disk 19, and the control valve body 17, the pressure chamber 31 can be connected to the high-pressure accumulation chamber 10 and consequently filled with highly pressurized fuel.

In the valve shim 24, there is a central opening 83, which connects the bore 30 to a spring chamber 40 embodied in the valve holding body 22. The spring chamber 40 here is embodied as a bore and extends coaxial to the bore 30. The central opening 83 has a smaller diameter than the bore 30 that guides the valve needle 32 so that a stop shoulder 35 is formed at the transition from the valve body 25 into the valve shim 24. The opening stroke of the valve needle 32 is defined by the axial distance between the end of the valve needle 32 remote from the combustion chamber and a stop shoulder 35 of the valve shim 24 when the fuel injection valve is in its closed position.

At its end remote from the combustion chamber, the valve needle 32 transitions into a pressure pin 37, which is coaxial to the valve needle 32 and is disposed in the central opening 83 of the valve shim 24. The pressure pin 37 transitions into a spring plate 42 disposed in the spring chamber 40; a closing spring 44, which is embodied as a helical compression spring, is disposed under an initial compressive stress between the spring plate 42 and the end of the spring chamber 40 remote from the combustion chamber. In this connection, the initial compressive stress of the closing spring 44 can be adjusted by means of the thickness of a compensating disk 45, which is disposed between the closing spring 44 and the end of the spring chamber 40 remote from the combustion chamber. By means of the spring plate 42 and the pressure pin 37, the force of the closing spring 44 presses the valve needle 32 with the valve sealing surface 34 against the valve seat 36 and thus closes the injection openings 38. The spring chamber 40 is connected to the fuel tank 1 by means of an overflow fuel line 69 so that fuel, which penetrates into the spring chamber 40, is discharged into the fuel tank 1, as a result of which a low fuel pressure constantly prevails in the spring chamber 40. At its end remote from the combustion chamber, the spring chamber 40 transitions into a through bore 46, which is disposed coaxial to the bore 30 and the spring chamber 40 and extends into a shutoff chamber 76 embodied in the intermediary disk 19.

Figure 2:
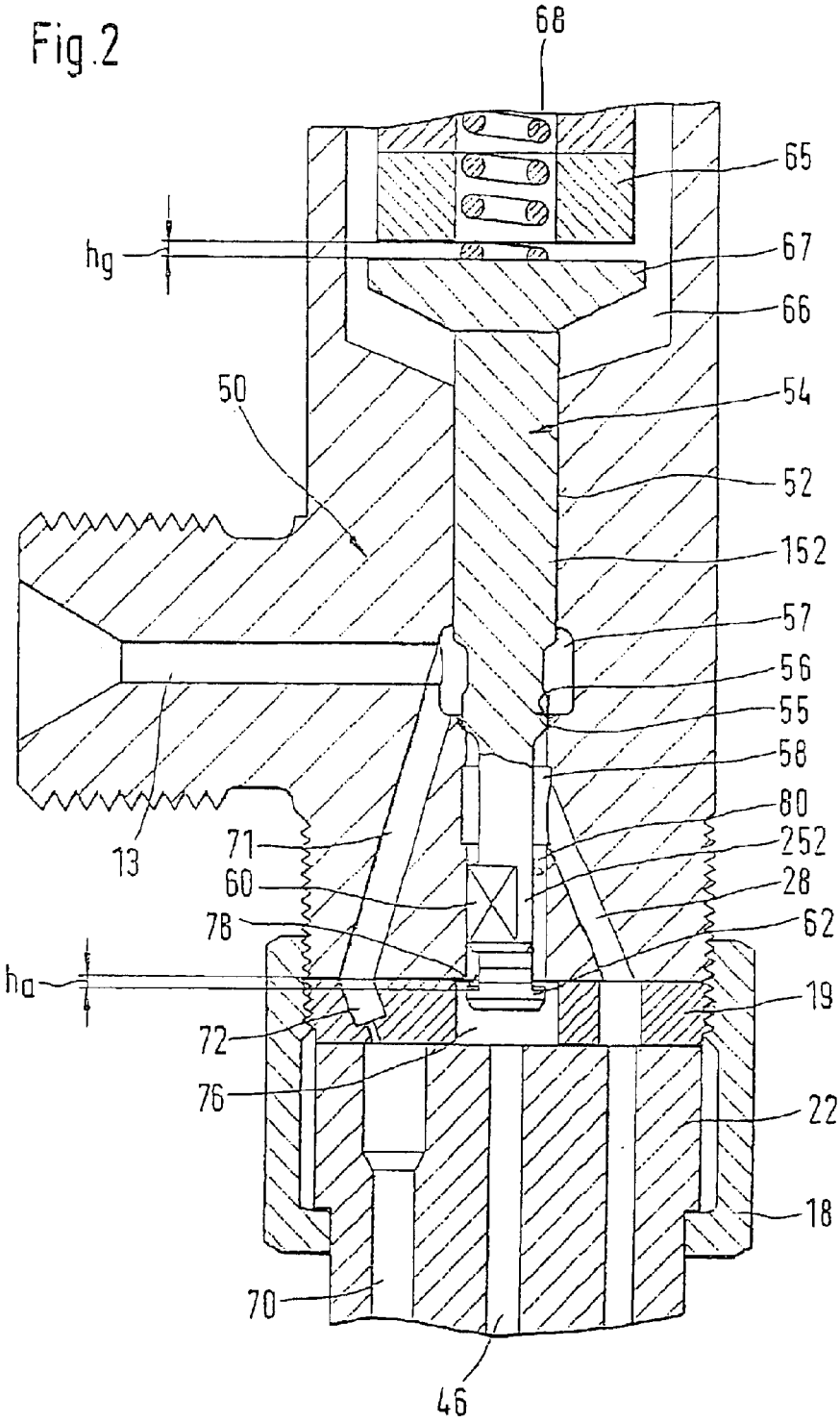
FIG. 2 shows an enlargement of FIG. 1, in the vicinity of the control valve.

FIG. 2 shows an enlargement of a longitudinal section through the control valve 50. The control valve bore 52 is divided into a sealing section 152 and a smaller diameter guiding section 252. At its end remote from the combustion chamber, the control valve bore 52 feeds into an overflow fuel chamber 66 embodied in the control valve body 17 and at its other end, opens into the shutoff chamber 76, which is connected to the spring chamber 40 by means of the through bore 46. A radial enlargement of the control valve bore 52 forms a first pressure chamber 57, which is connected to the high-pressure line 12 and therefore to the high-pressure accumulation chamber 10 by means of a supply conduit 13 embodied in the control valve body 17. Toward the valve holding body 22 from the first pressure chamber 57, an additional radial enlargement of the control valve bore 52 forms a second pressure chamber 58. The second pressure chamber 58 is fed by the supply bore 28, which connects the second pressure chamber 58 to the pressure chamber 31. At the transition from the first pressure chamber 57 to the second pressure chamber 58, an essentially conical control valve seat 56 is embodied on the wall of the control valve bore 52. A control valve member 54 is disposed so that it can move longitudinally in the control valve bore 52 and is guided in a sealed fashion in the sealing section 152 of the control valve bore 52. Starting from its section that is guided in a sealed fashion, the control valve member 54 tapers toward the valve holding body 22, forming a control valve sealing surface 55, which is embodied as essentially conical and cooperates with the control valve seat 56. The control valve member 54 extends through the second pressure chamber 58 into the shutoff chamber 76 embodied in the intermediary disk 19, where the control valve member 54 transitions into a control section 62, which is cylindrically embodied and has a diameter that is only slightly smaller than the diameter of the guiding section 252 of the control valve bore 52. Between the control section 62 and the second pressure chamber 58, the control valve member 54 is guided in the guiding section 252 of the control valve bore 52; recesses 60 are embodied on the control valve member 54 so that fuel can flow past the guided section of the control valve member 54. In the closed position of the control valve member 54, i.e. when the control valve sealing surface 55 is resting against the control valve seat 56, the annular end surface 78 of the control section 62 oriented toward the control valve body 17 is spaced axially apart from the beginning of the control valve bore 52 by a distance that corresponds to a shutoff stroke $h_a$.

At the end oriented away from the valve holding body 22, the control valve member 54 transitions into a magnet armature 67, which is disposed in the overflow fuel chamber 66; the overflow fuel chamber 66 is connected to the fuel tank 1 by means of an overflow fuel line 73. In the closed position of the control valve member 54, the magnet armature 67 is spaced apart by an axial distance $h_g$ from an electromagnet 65 also disposed in the overflow fuel chamber 66. The electromagnet 65 encompasses a valve spring 68, which is disposed under an initial stress between a stationary stop, not shown in the drawing, and the magnet armature 67 and acts on the control valve member 54 in the closing direction. The electromagnet 65 is disposed in a stationary manner in the overflow fuel chamber 66 and through a suitable supply of current, can exert an attractive force on the magnet armature 67, pulling it in the opening direction of the control valve 54 until it comes into contact with the electromagnet 65. This opening stroke motion of the control valve member 54 takes place counter to the closing force of the valve spring 68 so that when the supply of current to the electromagnet 65 stops, the valve spring 68 pushes the control valve member 54 back into the closed position.

In addition to the supply conduit 13, the first pressure chamber 57 is also connected to a line that is embodied as a connecting conduit 71. The connecting conduit 71 extends inclined in relation to the longitudinal axis of the control valve member 54 until it reaches the intermediary disk 19. A throttle 72 is embodied in the intermediary disk 19 through which the connecting conduit 71 communicates with a damping chamber 70 embodied in the valve holding body 22. The damping chamber 70 here is embodied as a blind bore, which extends parallel to the longitudinal axis 23 of the valve holding body 22 and parallel to the through bore 46. The blind bore that constitutes the damping chamber 70 can be of various lengths, depending on the desired volume of the damping chamber 70. It is also possible to embody the blind bore that constitutes the damping chamber 70 with various diameters.

Figure 3:
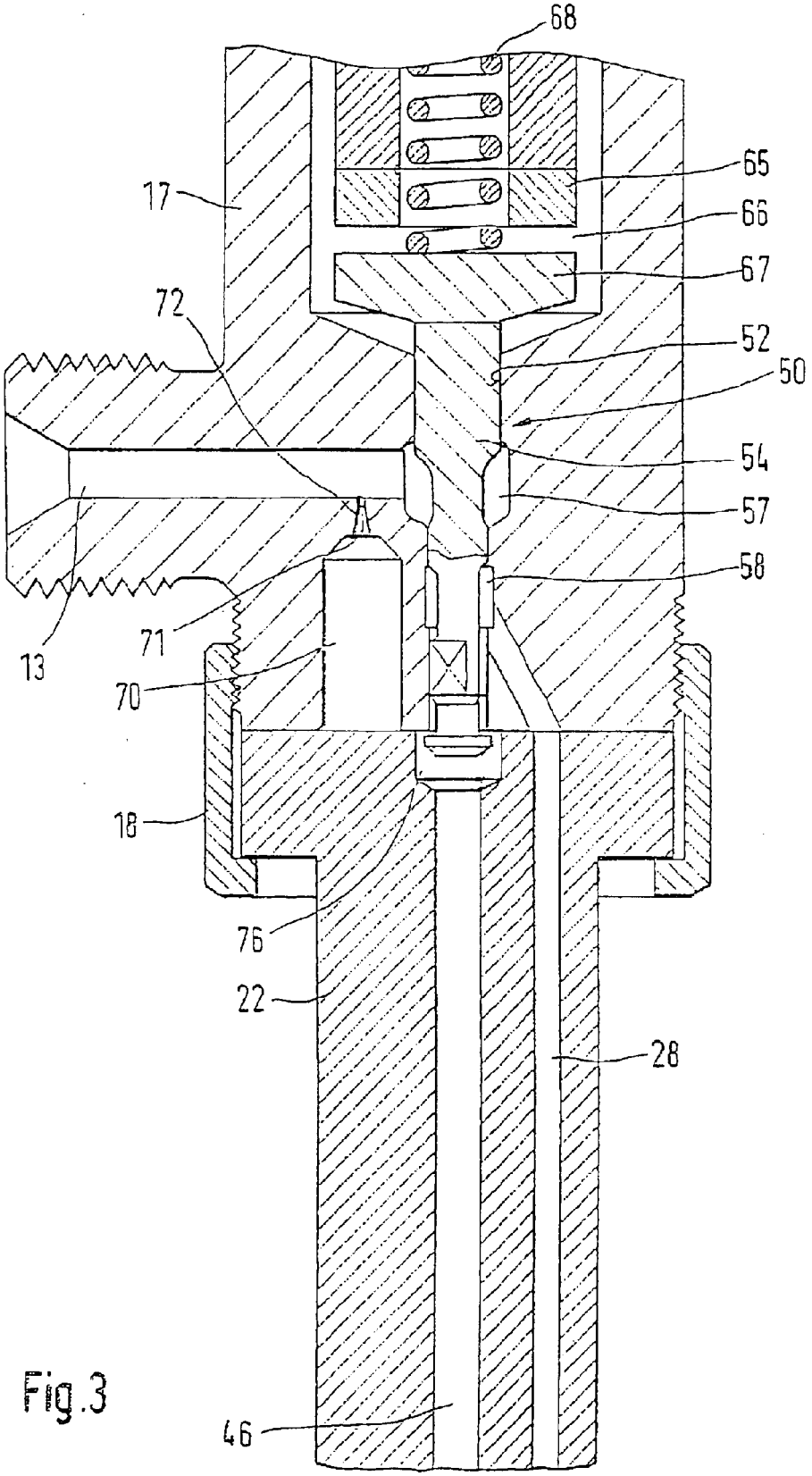
FIG. 3 shows the same detail as FIG. 2 of another exemplary embodiment.

FIG. 3 shows another exemplary embodiment of the fuel injection system according to the invention, depicting the same enlarged detail as the one shown in FIG. 2. The function and design correspond precisely to those of the exemplary embodiment shown in FIG. 2, but the damping chamber 70 here is depicted as a recess in the control valve body 17, which is cylindrically embodied and extends parallel to the control valve bore 52. A line, which is embodied as a connecting conduit 71, connects the damping chamber to the supply conduit 13, close to the first pressure chamber 57. Inside the connecting conduit 71, a throttle 72 is provided, which damps the flow of fuel through the connecting conduit 71. Since the damping chamber 70, the connecting conduit 71, and the throttle 72 are disposed inside the control valve body 17, the valve holding body 22 not have to be structurally altered in comparison to a fuel injection valve that does not have a damping chamber 70.

Figure 4:
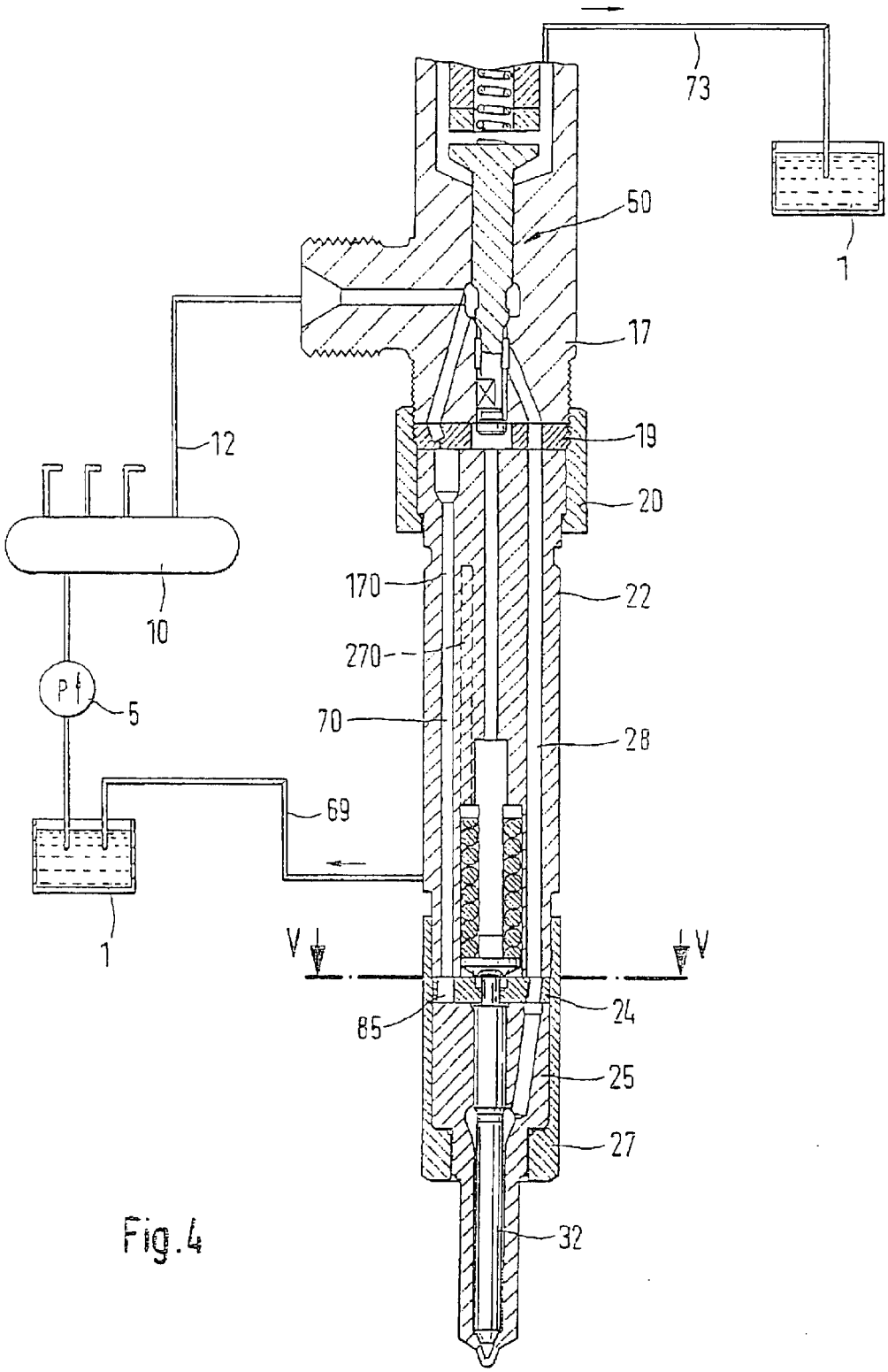
FIG. 4 shows another exemplary embodiment of a fuel injection system in the same view as FIG. 1.
Figure 5:
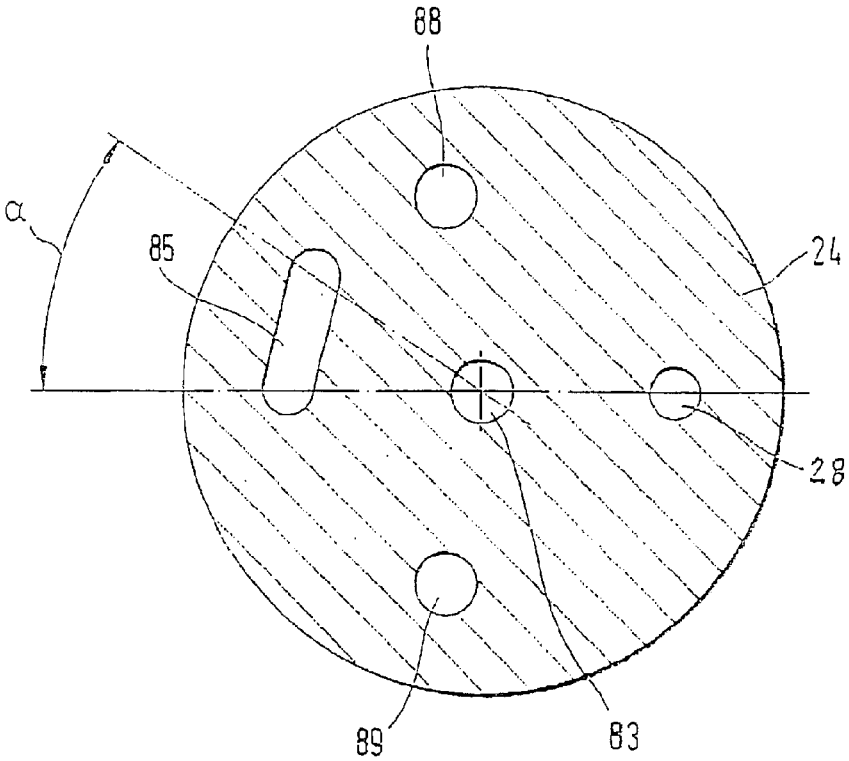
FIG. 5 shows a cross section through the fuel injection valve shown in FIG. 4, along the cutting line V—V, FIG. 6 schematically depicts another exemplary embodiment of a fuel injection system according to the invention.

FIG. 4 shows another exemplary embodiment of a fuel injection system according to the invention in which only the embodiment of the damping chamber 70 is changed in relation to FIG. 1. In this exemplary embodiment, the damping chamber 70 is embodied not as a single blind bore, but is divided into two bore sections 170, 270, which are embodied parallel to each other in the valve holding body 22. The first bore section 170 of the damping chamber 70 extends from one end of the valve holding body 22 to the other end, i.e. from the intermediary disk 19 to the valve shim 24. In the valve shim 24, the first bore section 170 of the damping chamber 70 feeds into a lateral connection 85, which has an oval to reniform shape in cross section, as depicted in FIG. 5 in a cross section through the valve shim 24. Starting from the end of the valve holding body 22 oriented toward the combustion chamber, a second bore section 270 of the damping chamber 70 is embodied in the valve holding body 22; this second bore section 270 is embodied as a blind bore and is offset around longitudinal axis 23 of the valve holding body 22 by an angle $\alpha$ in relation to the first bore section 170. The two bore sections 170 and 270 are connected to each other by the lateral connection 85 in the valve shim 24 so that they combine to form the damping chamber 70.

FIG. 5 shows a cross section through the fuel injection valve along the line V—V of FIG. 4. In addition to the central opening 83 and the lateral connection 85, two additional centering pin bores 88 and 89 are also provided in the valve shim 24. During assembly of the fuel injection valve, centering pins are inserted into these centering pin bores 88 and 89 and protrude into corresponding bores in the valve holding body 22 and in the valve body 25, thus assuring an exact positioning of these bodies in relation to one another.

The fuel injection system shown in FIGS. 1 to 5 functions as follows: by means of the fuel line 3, the high-pressure pump 5 delivers fuel from the fuel tank 1, via a high-pressure line 7 to the high-pressure accumulation chamber 10. A control unit, not shown in the drawing, maintains a predetermined high fuel pressure level in the high-pressure accumulation chamber 10. Pressure levels of up to 140 MPa are common in modern high-pressure accumulation chambers. From the high-pressure accumulation chamber 10, the fuel is conveyed to the fuel injection valves 15 via high-pressure lines 12. In the fuel injection valve 15, the fuel travels through the supply conduit 13 into the first pressure chamber 57. At the beginning of the injection cycle, the control valve 50 is in the closed position, i.e. the electromagnet 65 is not supplied with current and the valve spring 68 presses the control valve sealing surface 55 of the control valve member 54 against the control valve seat 56, thus closing the first pressure chamber 57 off from the second pressure chamber 58. The second pressure chamber 58 is connected by means of recesses 60 to the shutoff chamber 76, which is connected by means of the through bore 46 to the spring chamber 40, which is connected to the fuel tank 1. In this manner, a low fuel pressure, which corresponds to the pressure in the fuel tank 1, prevails in the second pressure chamber 58 and, by means of the supply bore 28 extending from the second pressure chamber 58, also prevails in the pressure chamber 31. Because of the connecting conduit 71, the same pressure prevails in the damping chamber 70 as in the first pressure chamber 57 and therefore also the same pressure as in the high-pressure accumulation chamber 10. When an injection is to take place, the electromagnet 65 is supplied with current so that the magnet armature 67 moves toward the electromagnet 65 counter to the force of the valve spring 68. The movement of the magnet armature 67 also causes the control valve member 54 to move and the control valve sealing surface 55 to lift up from the control valve seat 56. As a result, the first pressure chamber 57 is connected to the second pressure chamber 58. As long as the shutoff stroke ha has not yet been completed by the control valve member 54, the second pressure chamber 58 remains connected to the shutoff chamber 76 by means of the recesses 60 so that at the beginning of the stroke motion of the control valve member 54, fuel flows from the first pressure chamber 57 into the second pressure chamber 58 and from this, into the shutoff chamber 76. This sets the highly pressurized fuel quantity in the supply conduit 13 into motion and thus imparts kinetic energy to it. After the shutoff stroke $h_a$ is completed, the control section 62 travels into the control valve bore 52 and thus closes the second pressure chamber 58 off from the shutoff chamber 76. The fuel in the supply conduit 13, which is already in motion, then flows into the supply bore 28 and on into the pressure chamber 31, which is still closed, where the kinetic energy of the fuel is converted into compression work. This is accompanied by a pressure increase in the pressure chamber 31 and a pressure is produced, which is considerably higher than that in the high-pressure accumulation chamber 10. This higher pressure can be several tens of MPa higher than the pressure in the high-pressure accumulation chamber 10. The pressure in the pressure chamber 31 produces a hydraulic force on the pressure surface 33 of the valve needle 32, which is therefore moved in the axial direction away from the combustion chamber, counter to the force of the closing spring 44. As result, the valve sealing surface 34 also lifts up from the valve seat 36 and the injection openings 38 are unblocked so that fuel flows out of the pressure chamber 31, past the valve needle 32, to the injection openings 38, and from there, is injected into the combustion chamber of the internal combustion engine. The valve needle 32 in this instance continues its opening stroke motion until its end remote from the combustion chamber comes into contact with the stop shoulder 35 of the valve shim 24. When the injection is to be terminated, the electromagnet 65 is no longer supplied with current so that the valve spring 68 pushes the control valve member 54 back into the closed position. In the course of the closing motion of the control valve member 54, the control section 62 travels back out of the guide section 252 of the control valve bore 52, and connects the second pressure chamber 58—and therefore also the pressure chamber 31, by means of the supply bore 28—to the shut-off chamber 76, which is connected to the overflow fuel system. The pressure chamber 31 is consequently pressure-relieved and the force of the closing spring 44 on the valve needle 32 predominates over the hydraulic force exerted on the pressure surface 33, causing the valve needle 32 to travel back into the closed position. Since the fuel in the supply conduit 13 still has kinetic energy, after the control valve 50 is closed, this kinetic energy is converted into compression work so that the pressure in the first pressure chamber 57 increases. This overpressure causes a higher pressure to prevail in the first pressure chamber 57 than in the damping chamber 70 so that fuel then flows from the first pressure chamber 57, through the connecting conduit 71 and the throttle 72, into the damping chamber 70, where the pressure correspondingly increases as a result. The pressure wave thus flowing in the damping chamber 70 therefore decreases the pressure in the first pressure chamber 57 and increases the pressure in the damping chamber 70 until the pressure in the damping chamber 70 is higher than the pressure in the first pressure chamber 57. A part of the fuel then flows back through the throttle 72 and the connecting conduit 71, out of the damping chamber 70, and back into the pressure chamber 57, where the pressure correspondingly increases again. This pressure oscillation is damped by means of a throttle 72 so that by contrast with fuel injection systems that do not have a corresponding damping, the pressure oscillation here decays after a few oscillations and a constant pressure prevails once more in the first pressure chamber 57, which corresponds to the pressure in the high-pressure accumulation chamber 10. The intensity of the damping can be adapted to the requirements of the fuel injection valve by adjusting the cross section of a throttle 72 and the volume of the damping chamber 70.

Figure 6:
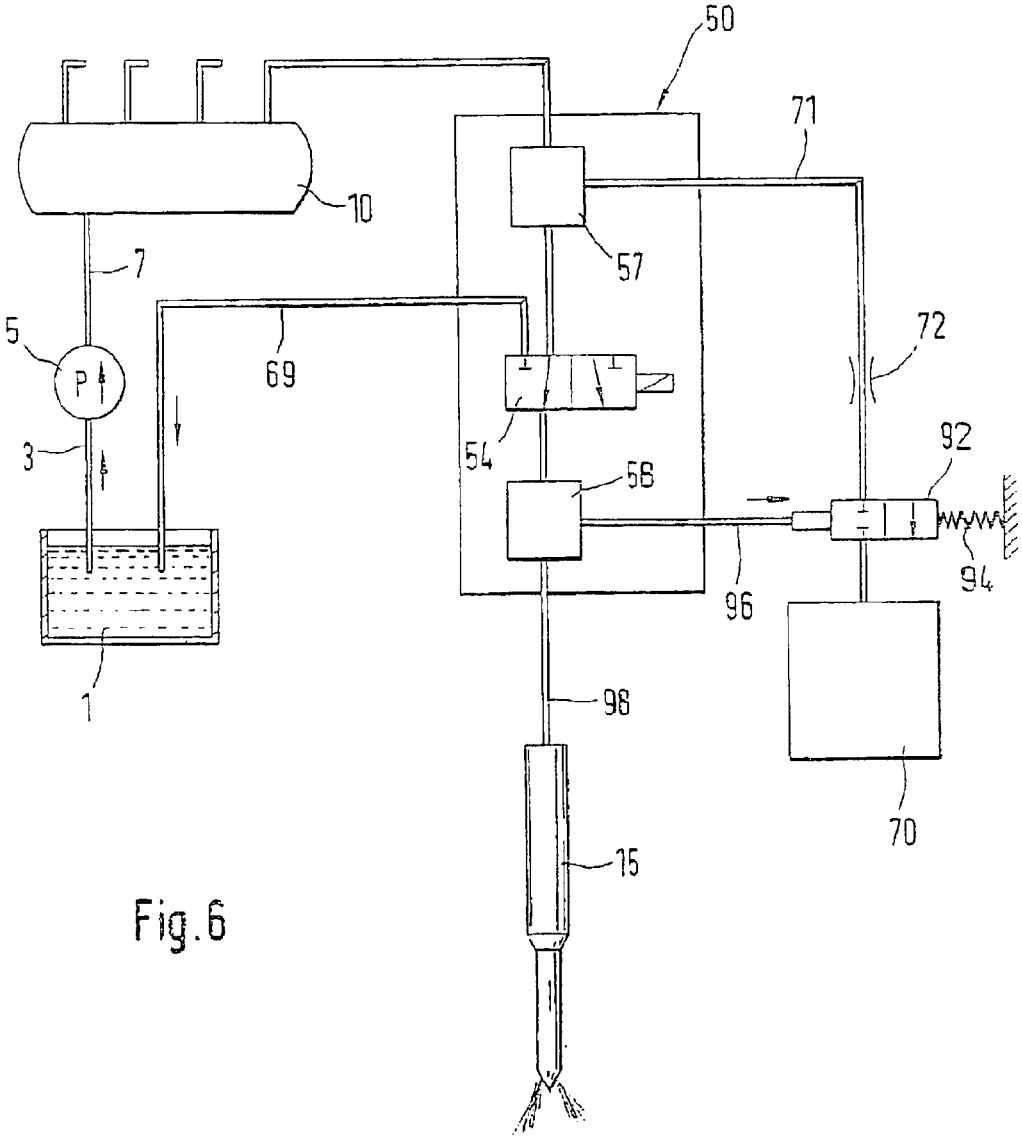

FIG. 6 shows another exemplary embodiment of the fuel injection system according to the invention, depicted as a schematic block circuit diagram. As in the exemplary embodiments described above, the control valve 50 functions as a 3/2-port directional-control valve, which appropriately connects the first pressure chamber 57, the second pressure chamber 58, and the overflow fuel line 69. The first pressure chamber 57 is connected to the damping chamber 70 by means of a connecting conduit 71 and a throttle 72; in this exemplary embodiment, a shutoff valve 92 is disposed between the throttle 72 and the damping chamber 70. The shutoff valve 92 is switched by the force of a spring 94 and by the pressure in the second pressure chamber 58, which acts on the shutoff valve 92 by means of a connecting line 96. If a corresponding high fuel pressure prevails in the second pressure chamber 58, which exerts a greater force on the shutoff valve 92 than the spring 94, then the shutoff valve 92 closes the connecting conduit 71 and the damping chamber 70 is no longer connected to the first pressure chamber 57 so that a pressure oscillation occurring in the first pressure chamber 57 is no longer damped. If the fuel pressure in the second pressure chamber 58 is correspondingly low, as is the case when the control valve 50 is closed, then the force of the spring 94 predominates over the force of the fuel pressure in the second pressure chamber 58 and the shutoff valve 92 opens the connection from the first pressure chamber 57 to the damping chamber 70.

The advantage of the shutoff valve 92 is that pressure oscillations in the first pressure chamber 57 are only damped when the control valve 50 is closed, i.e. when no injection is taking place. Namely, if the first pressure chamber 57 is continuously connected to the damping chamber 70 by means of the throttle 72, then even the desired pressure surge at the beginning of the injection is slightly damped so that the maximum achievable overpressure in the pressure chamber 31 is slightly lower than when the first pressure chamber 57 is closed, which has no damping otherwise. With the shutoff valve 92, therefore, a higher injection pressure is achieved with the same pressure in the high-pressure accumulation chamber 10. The shutoff valve 92 in this connection is advantageously also embodied in the control valve body 17 so that a compact design of the fuel injection system is once again possible and the switching of the shutoff valve 92 is not delayed by an unnecessarily long connecting line 96.

In addition to embodying the throttle 72 in the intermediary disk 19, it is also possible to embody the throttle location in the control valve body 17 or in the valve holding body 22. The intermediary disk 19 can be eliminated and one high-pressure sealing surface is therefore saved. In this instance, the shutoff chamber 76 is correspondingly disposed in the valve holding body 22. It is also possible to embody the damping chamber 70 by means of two bore sections 170, 270, but the connection of the bore sections 170, 270 is not embodied in the valve shim 24, but in the valve holding body 22. This produces a damping chamber that is at least approximately U-shaped in longitudinal section. A damping chamber of this kind can be produced, for example, with the aid of an end-milling cutter.

Figure 7:
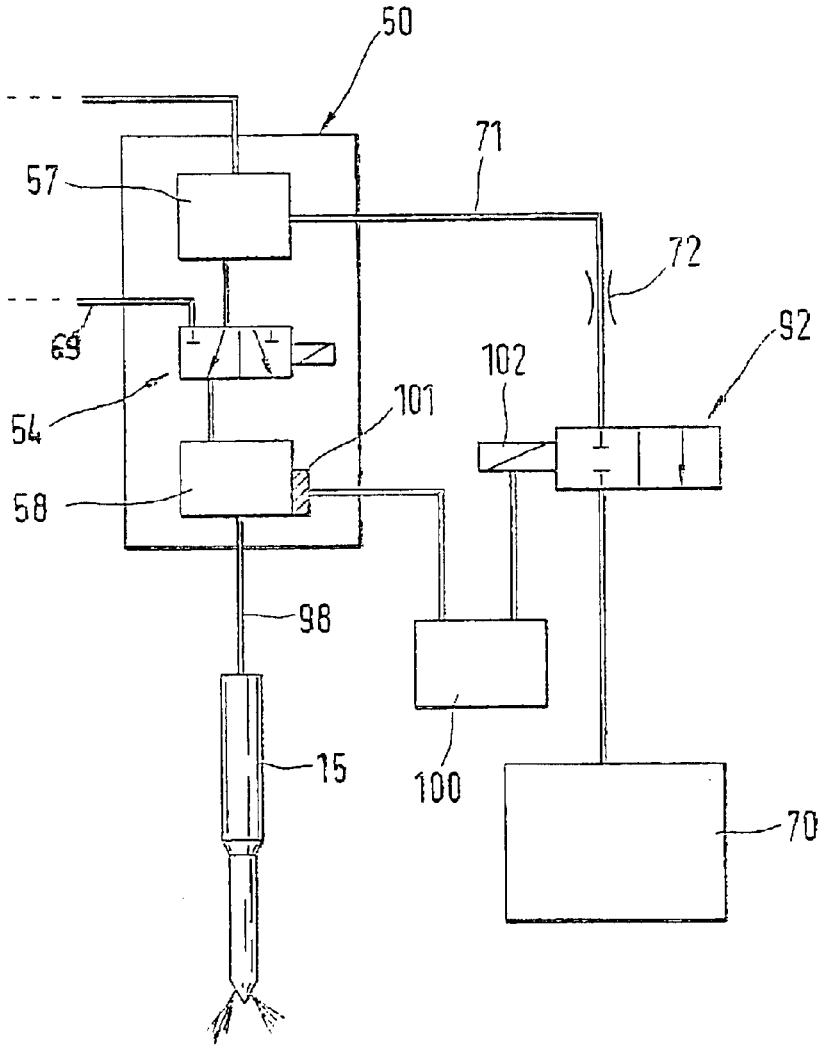
FIG. 7 shows a detail from FIG. 6 of another exemplary embodiment.

FIG. 7 shows a detail of another exemplary embodiment of the fuel injection system shown in FIG. 6. In this instance, the closing valve 92 is controlled not by the pressure in the second pressure chamber 58, but directly, for example by means of an electric actuator 102, which is activated by a control unit 100. Among other things, the control unit can use the pressure in the second pressure chamber 58 as an input variable; the pressure is measured by a sensor element 101.

Furthermore, it is also possible to embody the damping chamber 70 not as a bore, but as an arbitrarily shaped cavity in the valve holding body 22 and to connect it to the first pressure chamber 57 by means of a throttled connection. A damping chamber of this kind can be optimally adapted to the spatial conditions in a valve holding body 22. Furthermore, it is also possible to embody the damping chamber 70 in the control valve body 17, which eliminates a corresponding high-pressure sealing surface of the kind that is formed between the intermediary disk 19 and the valve holding body 22 or between the control valve body 17 and the intermediary disk 19.

It is also possible not to control the control valve 50 directly with the aid of electromagnet, as shown in the exemplary embodiments. Alternatively, the control valve member 54 can be controlled by a device, which moves the control valve member 54 into the open or closed position with the aid of hydraulic forces.

The control valve seat 56 of the control valve 50 is subjected to a high mechanical stress when contacted by the control valve sealing surface 55 during the longitudinal motion of the control valve member 52. It is therefore necessary to manufacture the control valve body 17 out of a hard, wear resisting steel. By contrast, producing the damping chamber 70 as a blind bore in a valve holding body 22 made of a hard steel can only be achieved with considerable difficulty. Since there are no surfaces in the valve holding body 22 that are subjected to high mechanical stresses, the valve holding body 22 can be made of a relatively soft steel in which bores can be easily produced.

The foregoing relates to preferred exemplary embodiments of the invention, it being understood that other variants and embodiments thereof are possible within the spirit and scope of the invention, the latter being defined by the appended claims.

What is claimed is:

1. A fuel injection system for internal combustion engines, comprising a fuel injection valve, which is supplied by a high-pressure fuel source and which has a valve member (32) that is adjustable by means of the pressure of a pressure chamber (31) embodied in the fuel injection valve and thereby controls an injection opening (38) that can be made to communicate with the pressure chamber (31), a control valve (50), which has a control valve member (54) which, in a first position, disconnects a first pressure chamber (57) that continuously communicates with the high-pressure fuel source from a supply line (28) leading to the pressure chamber (31), and in a second position, opens the communication between the high-pressure fuel source and the pressure chamber (31), and a line (17) having a throttle (72) between the high-pressure fuel source and the first pressure chamber (57), the line (71) leading to an otherwise closed damping chamber (70), wherein the damping chamber (7) is disposed inside the fuel injection valve.

2. The fuel injection system according to claim 1, wherein the line (71) leads from the first pressure chamber (57) to the damping chamber (70).

3. A fuel injection system for internal combustion engines, comprising a fuel injection valve, which is supplied by a high-pressure fuel source and which has a valve member (32) that is adjustable by means of the pressure of a pressure chamber (31) embodied in the fuel injection valve and thereby controls an injection opening (38) that can be made to communicate with the pressure chamber (31), a control valve (50), which has a control valve member (54) which, in a first position, disconnects a first pressure chamber (57) that continuously communicates with the high-pressure fuel source from a supply line (28) leading to the pressure chamber (31), and in a second position, opens the communication between the high-pressure fuel source and the pressure chamber (31), and a line (17) having a throttle (72) between the high-pressure fuel source and the first pressure chamber (57), the line (71) leading to an otherwise closed damping chamber (70), wherein the fuel injection valve comprises a control valve body (17), a valve holding body (22), and a valve body (25); the control valve body (17) and the valve body (25) being disposed at opposite ends of the valve holding body (22), the control valve (50) being disposed in the control valve body (17), and the valve member (32) being disposed in the valve body (25), and wherein the damping chamber (70) is embodied in the control valve body (17).

4. The fuel injection system according to claim 1, further comprising a shutoff valve (92) in the line (71) to the damping chamber (70), the shutoff valve (92) being operable to control the opening of the line (71).

5. The fuel injection system according to claim 3, further comprising a shutoff valve (92) in the line (71) to the damping chamber (70), the shutoff valve (92) being operable to control the opening of the line (71).

6. The fuel injection system according to claim 4, wherein the shutoff valve (92) is controlled by the hydraulic pressure in the supply conduit (28).

7. The fuel injection system according to claim 4, wherein the shutoff valve (92) opens the connection from the first pressure chamber (57) to the damping chamber (70) when there is a predetermined opening pressure in the supply conduit (28), and closes it when the pressure falls below this opening pressure.

8. The fuel injection system according to claim 4, wherein the shutoff valve (92) is actuated by a controllable electrical actuator (102).

9. The fuel injection system according to claim 1, wherein the high-pressure fuel source is a high-pressure accumulation chamber (10).

10. The fuel injection system according to claim 3, wherein the high-pressure fuel source is a high-pressure accumulation chamber (10).

11. The fuel injection system according to claim 4, wherein the high-pressure fuel source is a high-pressure accumulation chamber (10).

12. The fuel injection system according to claim 6, wherein the high-pressure fuel source is a high-pressure accumulation chamber(10).

13. The fuel injection system according to claim 7, wherein the high-pressure fuel source is a high-pressure accumulation chamber (10).

14. The fuel injection system according to claim 8, wherein the high-pressure fuel source is a high-pressure accumulation chamber (10).

* * * * *